US009481003B2

(12) United States Patent
Clark et al.

(10) Patent No.: US 9,481,003 B2
(45) Date of Patent: Nov. 1, 2016

(54) POP-UP IRRIGATION SPRINKLER WITH SHOCK ABSORBING RISER SPRING DAMPING CUSHION

(75) Inventors: Michael L. Clark, San Marcos, CA (US); Zachary B. Simmons, San Diego, CA (US); William D. Holton, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 1096 days.

(21) Appl. No.: 13/445,055

(22) Filed: Apr. 12, 2012

(65) Prior Publication Data

US 2013/0270361 A1 Oct. 17, 2013

(51) Int. Cl.

| | |
|---|---|
| ***B05B 15/10*** | (2006.01) |
| *B05B 3/04* | (2006.01) |
| *B05B 15/00* | (2006.01) |

(52) U.S. Cl.

CPC ..... *B05B 15/10* (2013.01); *B05B 3/04* (2013.01); *B05B 15/001* (2013.01)

(58) Field of Classification Search

CPC ..... B05B 15/10; B05B 3/021; B05B 3/04; B05B 15/001

USPC ..... 239/237, 240, 242, 201, 203, 204, 205, 239/206

See application file for complete search history.

(56) References Cited

U.S. PATENT DOCUMENTS

| | | | | |
|---|---|---|---|---|
| 4,010,901 | A * | 3/1977 | Sheets | 239/204 |
| 5,823,439 | A * | 10/1998 | Hunter | B05B 15/10 239/203 |
| 5,823,440 | A | 10/1998 | Clark | 239/206 |
| 5,918,812 | A * | 7/1999 | Beutler | 239/205 |
| 5,927,607 | A | 7/1999 | Scott | 239/205 |
| 5,988,523 | A | 11/1999 | Scott | 239/114 |
| 6,082,632 | A | 7/2000 | Clark et al. | 239/205 |
| 6,439,476 | B1 * | 8/2002 | Boggs | 239/203 |
| 6,457,656 | B1 | 10/2002 | Scott | 239/205 |

* cited by examiner

*Primary Examiner* — Arthur O Hall
*Assistant Examiner* — Juan C Barrera
(74) *Attorney, Agent, or Firm* — Knobbe, Martens, Olson & Bear, LLP

(57) ABSTRACT

A pop-up rotor-type irrigation sprinkler includes an outer case and a riser assembly telescopically extensible from the outer case. A coil spring surrounds the riser assembly and normally holds the riser assembly in a lower retracted position within the outer case. The coil spring is dimensioned and configured to permit extension of the riser assembly to a raised upper position when pressurized water is introduced into the outer case. A cushion made of an elastomeric material is retained in the outer case adjacent an end thereof and surrounds the riser assembly. The cushion may be solid and may move between hard structures to facilitate absorption of the shock of the impact caused by rapid extension of the riser assembly to its raised upper position. The cushion may also include a plurality of voids that facilitate deformation and shock absorption.

20 Claims, 17 Drawing Sheets

POP-UP IRRIGATION SPRINKLER WITH SHOCK ABSORBING RISER SPRING DAMPING CUSHION

FIELD OF THE INVENTION

The present invention relates irrigation, and more particularly, to pop-up sprinklers for watering turf and landscaping.

BACKGROUND

The artificial distribution of water onto plants through irrigation systems is in wide use throughout the world today. Many irrigation systems are installed for watering lawns, shrubs, golf courses, and athletic fields. The typical irrigation system for such applications includes a programmable electronic irrigation controller that turns a plurality of solenoid actuated valves ON and OFF in accordance with a watering schedule. The valves deliver water through subterranean pipes to a plurality of sprinklers spaced around the irrigation site. One of the most popular sprinklers currently in use for watering golf courses and athletic fields is the pop-up rotor-type sprinkler. This sprinkler includes a vertically telescoping cylindrical riser that is normally in a retracted position within an outer cylindrical case whose flanged upper end is flush with the surface of the ground. The riser is surrounded by a coil steel spring that holds the riser in its lowered position within the outer case. When the water to the sprinkler is turned ON, the riser telescopes to its raised position. The riser contains a turbine that drives a nozzle turret through a gear train reduction. The riser also usually contains a reversing mechanism that is manually adjustable to set the arc of oscillation of the nozzle turret. Some rotor-type sprinklers can be set to a full circle rotation mode. Large rotor-type sprinklers sometimes include an ON/OFF valve in the lower portion of the outer case. These sprinklers are referred to as valve-in-head sprinklers.

Rotor-type sprinklers that are used on golf courses and playing fields often eject a stream of water seventy feet or more. These sprinklers sometimes operate at water pressures above one-hundred pounds per square inch. They are subjected to extreme forces over their lifetime of use which can damage them and reduce their useful life. The most serious of these forces results from water hammer and high pressure surges that occur during system winterization and spring recharge. Winterizing involves blowing high pressure air through the pipes to remove the water to prevent damage to the sprinklers from water freezing in the sprinklers. In the spring, high pressure water is re-introduced into the pipes that lead to the sprinklers. The high impact forces experienced by a pop-up rotor type sprinkler are especially prevalent when an empty pipe is being filled with water at a high water pressure. Slugs of water separated by air pockets accelerate down the length of the pipe, and rapidly open the valve in the bottom of the outer case and slam the lower end of the riser to the end of its stroke against a retaining ring positioned at the upper end of the outer case. Due to the high water pressures and large pipe sizes for large turf applications these forces can be extremely high and frequently cause damage to the gear train reduction, reversing mechanism, and other delicate parts of the sprinkler. This often necessitates removal and replacement of the riser. In some cases, the entire sprinkler must be dug out of the ground and replaced. This is especially difficult and inconvenient on a golf course.

Attempts to solve the foregoing problem by making pop-up rotor type sprinklers heavier and stronger have been unsatisfactory because of increased costs. The dual medium of water and air makes it difficult to employ slow opening valves.

U.S. Pat. No. 5,823,440 of Mike Clark assigned to Hunter Industries, Inc., the assignee of the subject application, discloses a pop-up rotor type sprinkler with a pressure responsive inlet valve including a damper designed to lessen the adverse effects of the riser being slammed against the structures limiting the extent of its upward extension. This sprinkler includes a damping piston that allows the inlet valve to restrict the velocity or rate of flow of water and/or air into the outer case.

U.S. Pat. No. 5,823,439 of Richard E. Hunter et al. also assigned to Hunter Industries, Inc., discloses a rotor-type sprinkler with a shock absorbing coating on the riser retraction spring for absorbing the shock of the termination of rapid upward movement of the riser. The coating on the riser retraction spring is made of a soft yieldable plastic.

U.S. Pat. No. 5,918,812 of Matthew Grant Beutler, also assigned to Hunter Industries, Inc., discloses a rotor-type sprinkler with an elastic band between the riser retraction spring and the riser flange for absorbing the shock of the termination of rapid upward movement of the riser. The band may be made of soft natural rubber.

The Hunter® G900 golf and large turf rotor-type sprinklers have incorporated a compressible cylindrical sleeve between the bottom of the riser retraction spring and a flange on the lower end of the riser to absorb the shock of the termination of rapid upward movement of the riser. However, the substantial vertical height of the compressible sleeve has limited the height that the nozzle turret can be extended above ground level during watering.

While the aforementioned solutions may be beneficial, there is a need for a less expensive and more effective means for reducing or eliminating the aforementioned substantial impact forces to lessen the likelihood of damage to rotor-type sprinklers and thereby increase their useful life.

SUMMARY

In accordance with the present invention an irrigation sprinkler includes an outer case and a riser assembly telescopically extensible from the outer case. A coil spring surrounds the riser assembly and normally holds the riser assembly in a lower retracted position within the outer case. The coil spring is dimensioned and configured to permit extension of the riser assembly to a raised upper position when pressurized water is introduced into the outer case. A nozzle is mounted at an upper end of the riser. A cushion made of an elastomeric material is retained inside the outer case adjacent an end thereof and surrounds the riser assembly. The elastomeric cushion may move between hard peripheral supporting surfaces to facilitate absorption of the shock of the impact caused by rapid extension of the riser assembly to its raised upper position. The cushion may also be formed with a plurality of voids to facilitate shock absorption.

DETAILED DESCRIPTION

The present invention provides a rotor-type sprinkler with a novel shock absorbing mechanism that reduces or eliminates the substantial impact forces encountered during rapid extension of the riser assembly in order to provide the sprinkler with a longer useful life.

Figure 1A:
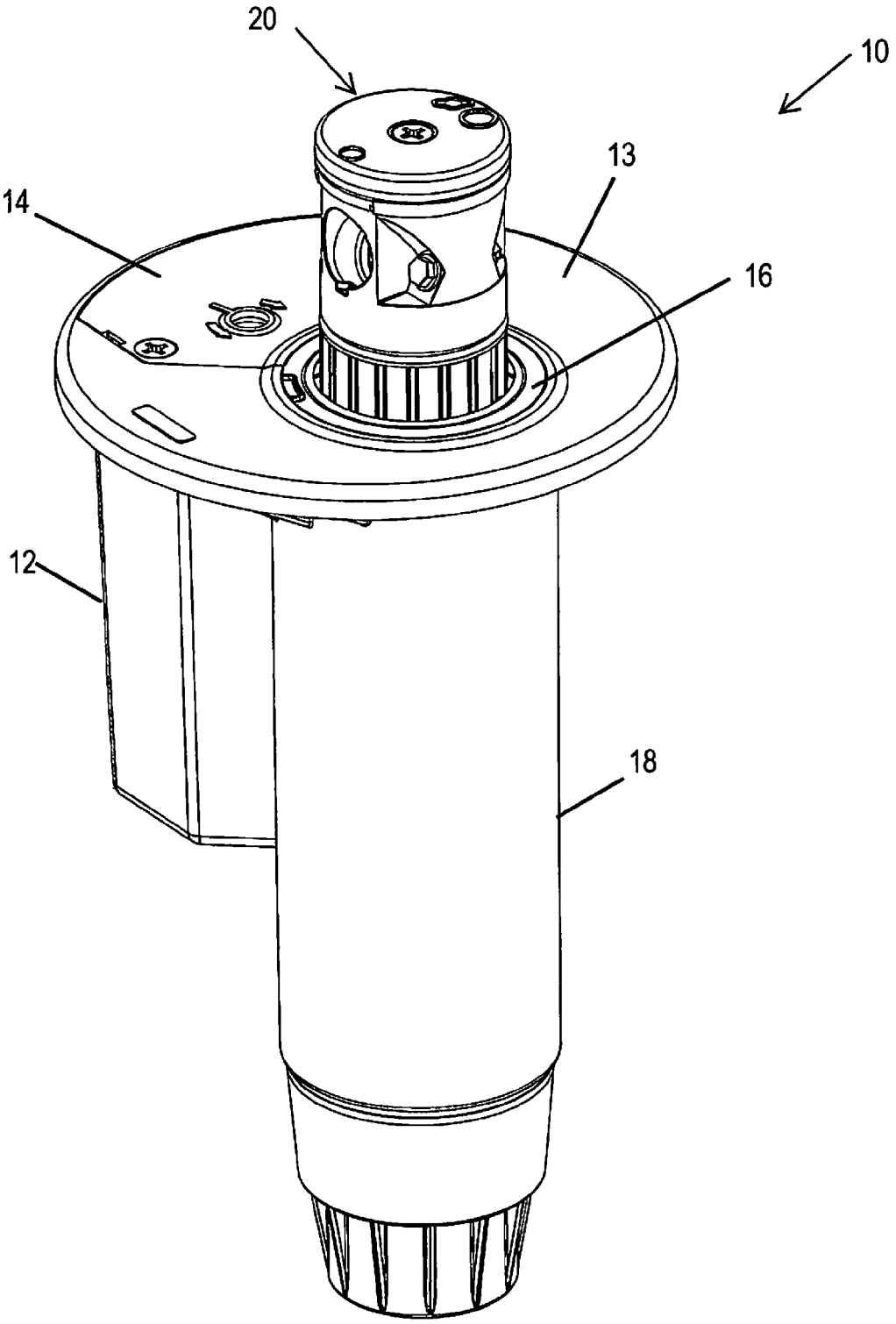
FIG. 1A is an isometric view of a pop-up rotor-type irrigation sprinkler that can beneficially utilize the present invention.
Figure 1B:
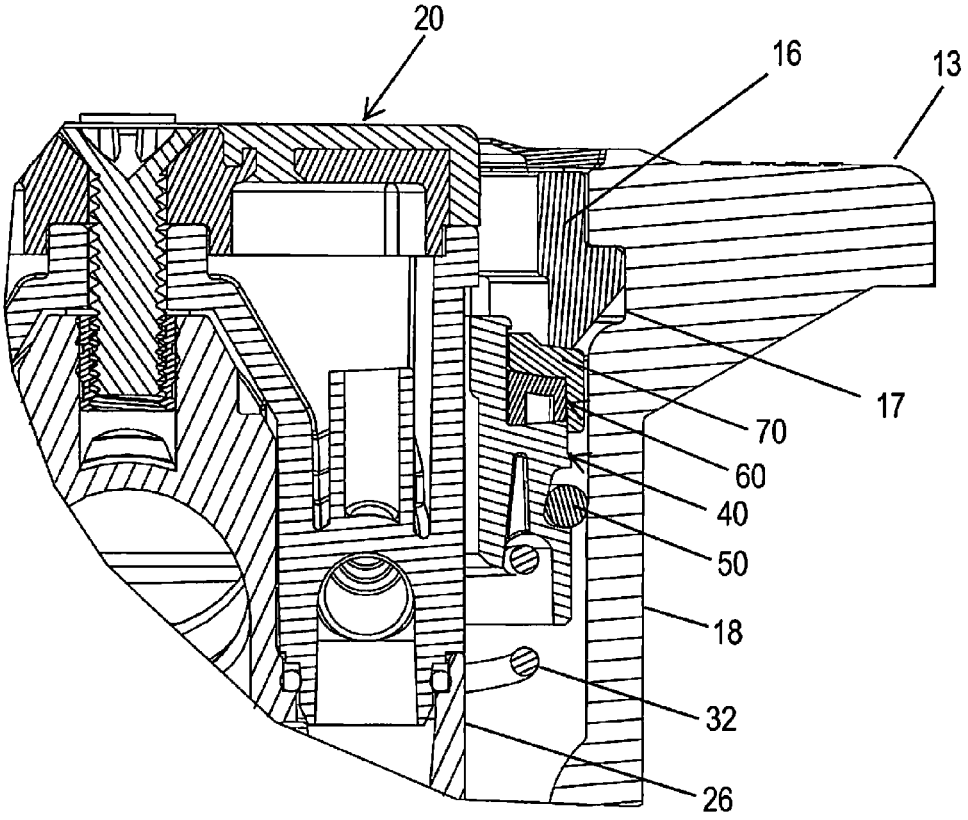
FIG. 1B is an enlarged fragmentary vertical sectional view of a portion of the sprinkler of FIG. 1A illustrating details of its upper spring seat, cushion and shield that form part of a first embodiment of the present invention.
Figure 2:
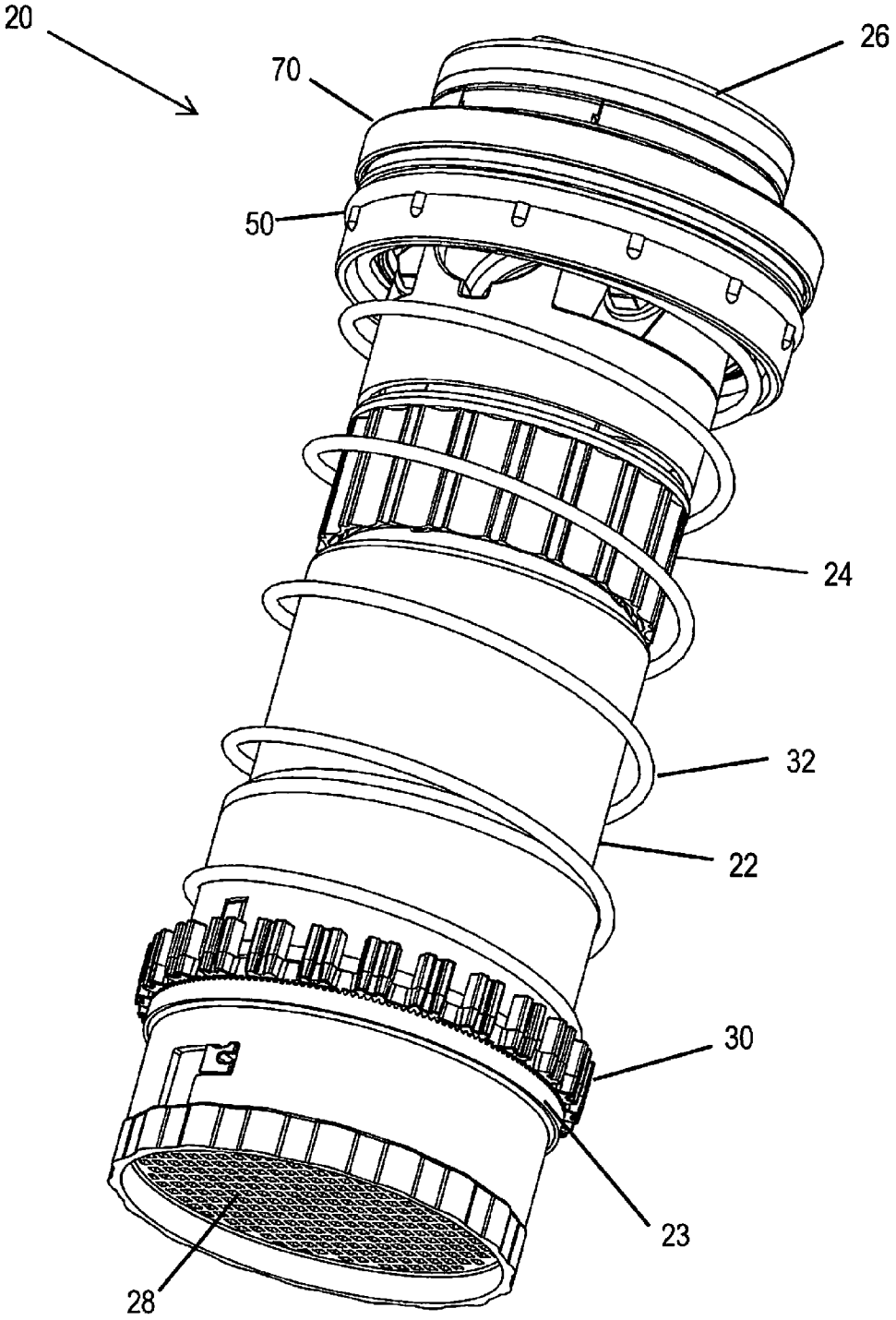
FIG. 2 is an enlarged isometric view of a riser assembly that can be used in the sprinkler of FIG. 1A and which incorporates the first embodiment of the present invention.
Figure 3:
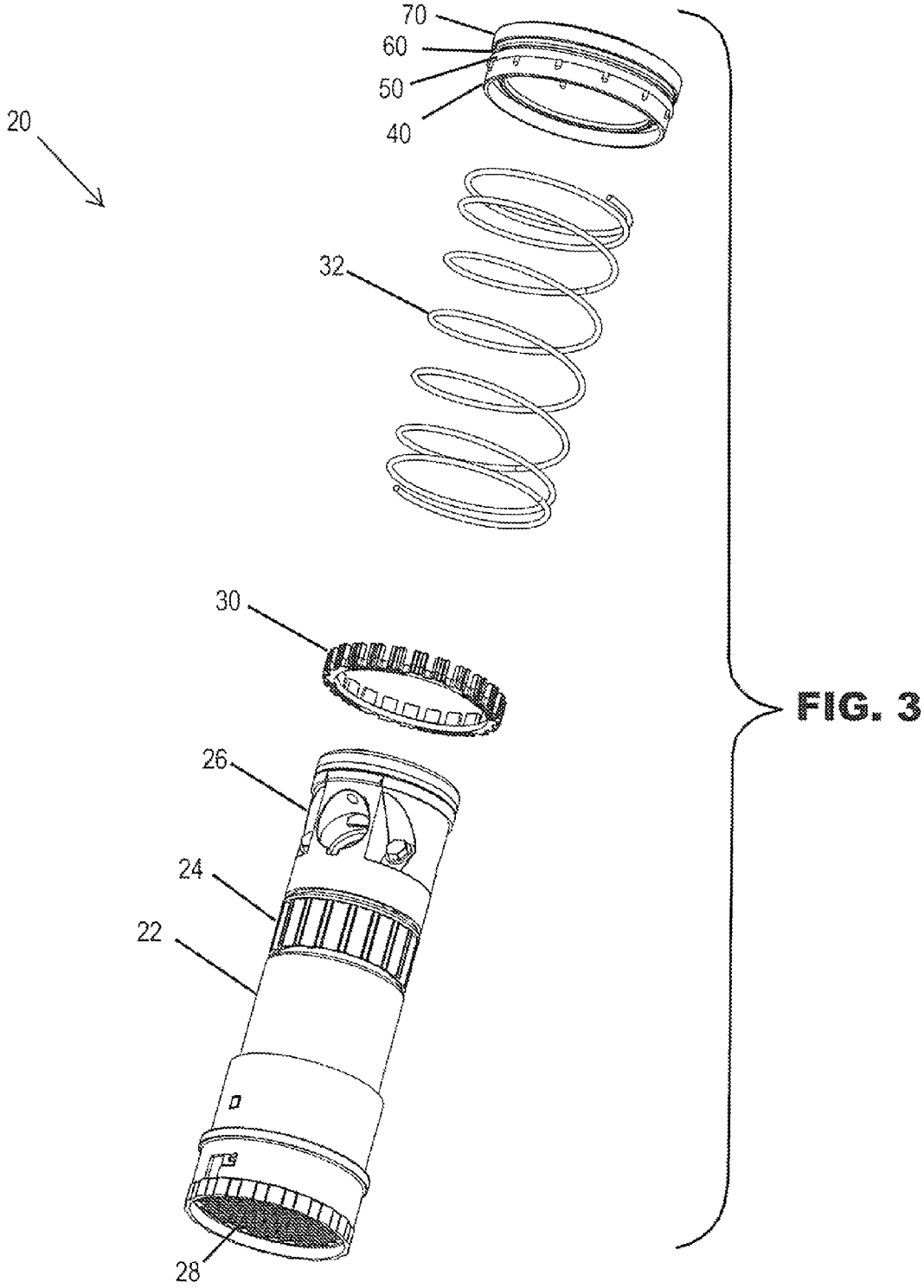
FIG. 3 is a slightly reduced exploded isometric view of the riser assembly of FIG. 2.

Referring to FIGS. 1A and 1B, a pop-up rotor-type irrigation sprinkler 10 includes a generally rectangular housing 12 that is sized and configured to hold control components. A large horizontal disc-shaped flange 13 at the upper end of the sprinkler 10 has an aperture sealed with a removable cover 14 that facilitates access to the components in the housing 12 for servicing. A snap ring 16 fits into a snap ring groove 17 formed on an inner diameter of a generally cylindrical outer case 18. The housing 12, flange 13 and case 18 are preferably injection molded as one integral unit out of a suitable hard black colored plastic material such as acrylonitrile butadiene styrene (ABS) plastic the includes chemical additives to resist degradation from ultraviolet (UV) radiation from the sun. The cover 14 is preferably molded out of the same ABS plastic. The snap ring 16 may be of the type disclosed in U.S. Pat. No. 5,988,523 of Loren Scott granted Nov. 23, 1999 and entitled "Pop-Up Sprinkler Unit with Split Containment Ring" assigned to Hunter Industries, Inc., the entire disclosure of which is hereby incorporated by reference. The snap ring 16 holds a telescoping riser assembly 20 securely in the case 18. Referring to FIGS. 2 and 3 the riser assembly 20 includes tubular riser 22 that houses the internal gear drive mechanisms (not illustrated) of the sprinkler 10. These include a gear train reduction, a turbine mounted to an input shaft of the gear train reduction and rotatable by water entering the lower end of the riser 22, and a reversing mechanism driven by the gear train reduction. The user turns a side adjusting ring 24 to set an arc of coverage typically from about forty to three hundred and sixty degrees. The riser assembly 20 further includes a cylindrical nozzle turret 26 that is rotatably mounted at the top of the riser 22. The reversing mechanism couples the gear train reduction and the nozzle turret 26. The nozzle turret 26 includes a socket with a removable nozzle (not illustrated). The nozzle turret 26 oscillates back and forth according to the arc set by the manual setting of the side adjusting ring 24. The nozzle turret 26 accepts removable nozzles and nozzle plugs, as disclosed in U.S. patent application Ser. No. 13/154,698 filed by Michael L. Clark et al. on Jun. 7, 2011 and assigned to Hunter Industries, Inc. entitled "Irrigation Sprinkler with Re-configurable Secondary Nozzle Holder" the entire disclosure of which is hereby incorporated by reference.

Details of suitable gear train reductions, reversing mechanisms, mechanisms for coupling the reversing mechanism to the nozzle, and arc adjusting mechanisms are disclosed in various patent applications and patents assigned to Hunter Industries, Inc. and need not be described in detail herein. For example, see U.S. patent application Ser. No. 13/343,522 filed Jan. 4, 2012 by Michael L. Clark et al. assigned to Hunter Industries, Inc. entitled "Rotor-Type Irrigation Sprinkler with Coarse and Fine Arc Adjustment" the entire disclosure of which is hereby incorporated by reference. See also U.S. patent application Ser. No. 13/343,456 filed Jan. 4, 2012 by Ronald H. Anuskiewicz et al. assigned to Hunter Industries, Inc. entitled "Planetary Gear Drive Rotor-Type Sprinkler with Adjustable Arc/Full Circle Selection Mechanism" the entire disclosure of which is hereby incorporated by reference. See also U.S. Pat. No. 7,677,469 of Michael L. Clark granted Mar. 16, 2010 assigned to Hunter Industries, Inc. entitled "Sprinkler with Reversing Planetary Gear Drive" the entire disclosure of which is hereby incorporated by reference. See also U.S. Pat. No. 6,227,455 of Scott et al. granted May 8, 2001 assigned to Hunter Industries, Inc. entitled "Sub-Surface Sprinkler with Surface Accessible Valve Actuator Components" the entire disclosure of which is hereby incorporated. See also U.S. Pat. No. 6,491,235 of Scott et al. granted Dec. 10, 2002 assigned to Hunter Industries, Inc. entitled "Pop-Up Sprinkler with Top Serviceable Diaphragm Valve Module" the entire disclosure of which is hereby incorporated.

A rock screen 28 (FIGS. 2 and 3) is removably attached to the lower end of the riser 22 to prevent large contaminates from entering the riser 22. See U.S. patent application Ser. No. 13/168,822 filed by Ronald H. Anuskiewicz on Jun. 24, 2011 assigned to Hunter Industries, Inc. entitled "Irrigation Sprinkler with Twist-And-Lock Debris Screen" the entire disclosure of which is hereby incorporated by reference. A lower ring-shaped spring seat 30 loosely slides over an outer diameter of the riser 22 and sits on a flange 23 on the riser 22 in order to support a lower end of a stainless steel coil spring 32. The coil spring 32 surrounds the riser 22 and normally holds the riser assembly 20 in a retracted position inside the case 18. The riser assembly 20 vertically reciprocates through a circular aperture in the disc-shaped flange 13. The flange 13 is preferably integrally molded at the upper end of the case 18. When pressurized water is supplied through an inlet at the lower end of the case 18 the riser assembly 20 rapidly moves upwardly relative to the case 18 in telescopic fashion to a raised upper position. During this extension of the riser assembly 20 the coil spring 32 is compressed. When the pressurized water being supplied to the inlet of the case 18 is shut off, the force of the compressed spring 32 pushes the riser assembly 20 back down to its lower retracted position in which the upper surface of the nozzle turret 26 is substantially flush with the upper side of the flange 13 (FIG. 1A).

Unless otherwise indicated, the components of the sprinkler 10 are injection molded out of suitable hard plastic material, with the exception of its springs and the shafts of the gear train reduction which are made of metal.

The upper side of the flange 23 includes a plurality of identical equally circumferentially spaced small teeth that mesh with mating small teeth formed on the underside of the spring seat 30. This allows the user to radially adjust the position of riser assembly 20 relative to the case 18 without removing the riser assembly 20 from the case 18. An upper spring seat 40 (FIG. 3), an O-ring 50, a ring-shaped cushion 60 and an upper ring-shaped shield 70 combine to provide a shock absorbing structure that absorbs the shock of the impact that occurs when the riser assembly 20 reaches its fully extended position after rapid vertical travel of the riser assembly 20. The cushion 60 is retained inside the outer case 18 adjacent an upper end thereof as hereafter described.

Figure 4A:
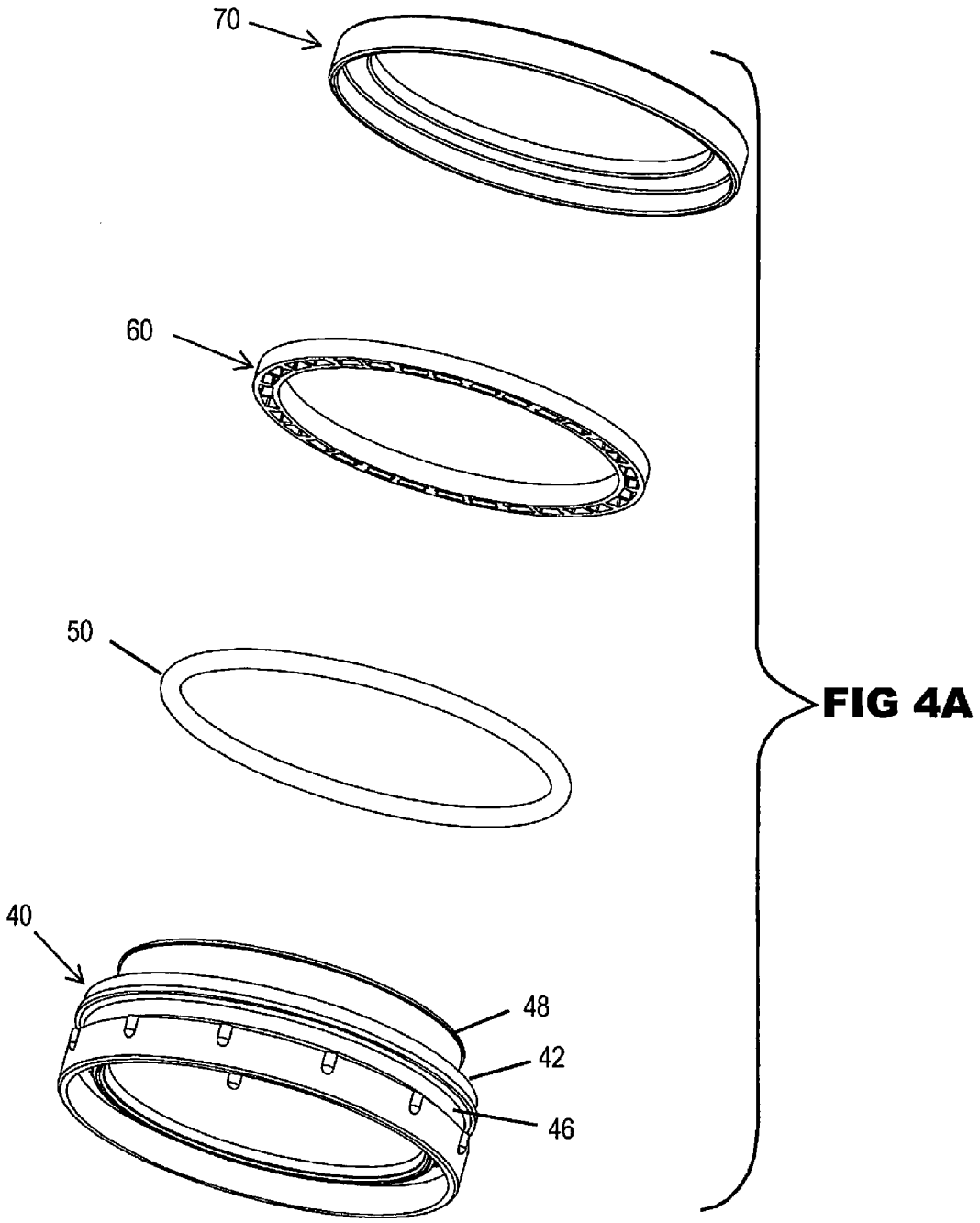
FIG. 4A is an enlarged exploded isometric view the upper spring seat, cushion, and shield of the first embodiment. In the first embodiment the cushion is molded with a plurality of circumferentially spaced voids.
Figure 4B:
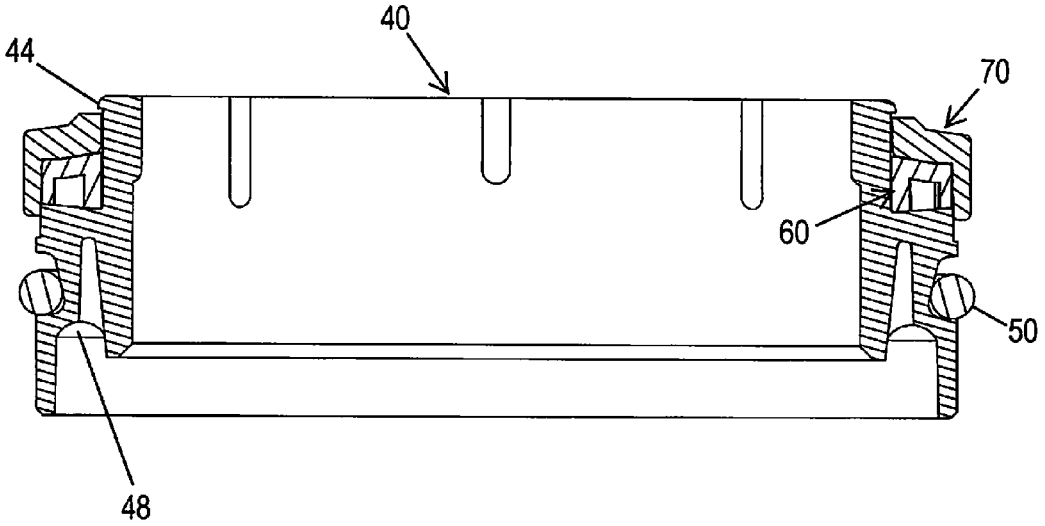
FIG. 4B is an enlarged vertical sectional view through the assembled components illustrated in FIG. 4A.
Figure 4C:
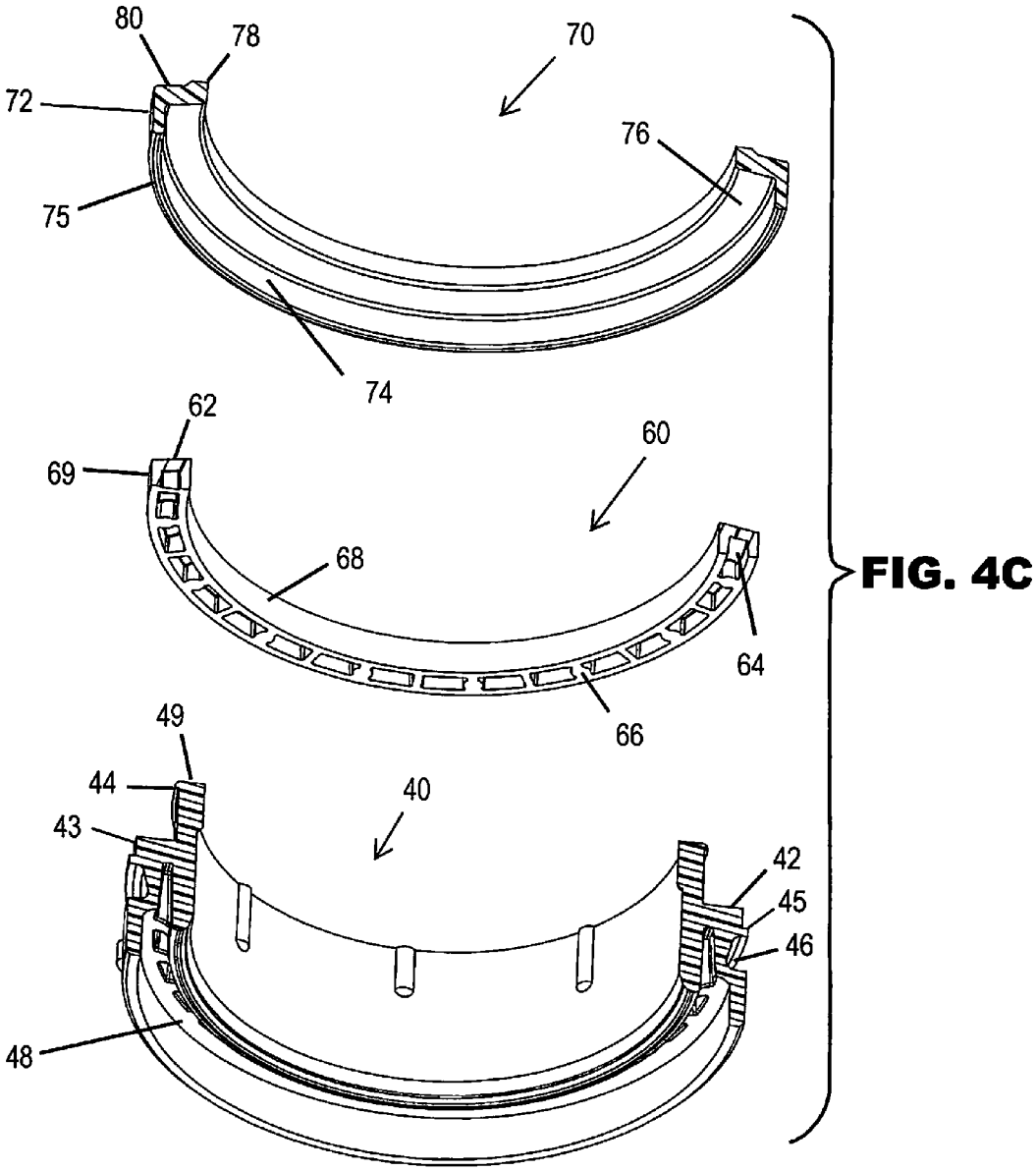
FIG. 4C is an exploded isometric view of the components illustrated in FIG. 4B in which the components have been vertically sectioned.

Referring to FIGS. 4A, 4B and 4C, an upper ring-shaped spring seat 40 includes a circular recess 48 (FIG. 4B) formed on its underside to receive the upper end of the coil spring 32. A groove 46 (FIGS. 4A and 4C) is formed on an outer diameter of the upper spring seat 40 to securely hold the O-ring 50. The O-ring 50 seals against the inner surface of the case 18 to prevent pressurized water from leaking out of the sprinkler 10. The cushion 60 sits on a shoulder 42 of the upper spring seat 40. The cushion 60 is formed with a plurality of box-shaped hollow voids 64 (FIG. 4C) that are positioned between an upper wall 62, a plurality of cross ribs 66, a radially inner wall 68, and a radially outer wall 69. The upper wall 62 may be eliminated and the voids 64 may be through holes. Furthermore the upper wall 62 may be formed with some of the voids 64 formed under the upper wall 62, and openings in the upper wall 62 such that some of the voids 64 are through holes. The voids 64 in the embodiment illustrated in FIGS. 4A, 4B and 4C are identical and are equally circumferentially spaced and take the form of downwardly opening five-sided pockets. The cushion 60 is preferably molded out of a flexible elastomer, such as Pellethane TPE 2103-85AE. The cushion 60 can absorb shock and load forces because the elastomeric walls and ribs deform and collapse slightly when the riser 22 reaches its uppermost limit. The incorporation of the voids 64 into the cushion 60 allows the cushion 60 to be manufactured out of a higher durometer material than could be accomplished with a solid elastomeric cushion. For example, the cushion 60 may have a durometer in the range of about sixty to about eighty on the Shore A hardness scale.

The shield 70 has an outer axially extending flange 72 (FIG. 4C) that surrounds and retains the cushion 60 when the riser assembly 20 is assembled inside the outer case 18. An inner annular surface 74 of the flange 72 fits over the outer axially extending wall 69 of the cushion 60. A horizontal flat disc-shaped surface 76 on the underside of the shield 70 sits on the upper horizontal flat wall 62 of the cushion 60 to keep the cushion 60 contained when it is being deformed under substantial load. An upper annular lip 78 formed on the shield 70 extends axially adjacent an annular radially extending lip 44 formed on the upper spring seat 40. The lip 44 extends radially over the annular lip 78 and keeps the shield 70 and the cushion 60 assembled to the upper spring seat 40. The outer flange 72 fits loosely around the outer annular surface 43 of the spring seat 40. The bottom surface 75 of the shield 70 may contact a radially projecting shoulder 45 of the spring seat 40 to limit the amount of axial deformation of the cushion 60 in terms of reducing its overall height. This limit may never be reached depending on the elastomeric properties of the cushion 60 and the pressure and velocity of the water entering the sprinkler 10. To accomplish the shock damping effect, an upper horizontal annular wall 80 of the shield 70 is retained in the case 18 by the snap ring 16 as best seen in FIG. 1B. When the riser assembly 20 reaches its fullest extension, the cushion 60 collapses slightly. The shield 70 and the spring seat 40 move axially relative to each other as the cushion 60 collapses to thereby reduce the shock on the riser assembly 20.

The flexible elastomeric cushion 60 is supported or confined on each of its four exterior surfaces by more rigid structures of the spring seat 40 and the shield 70 which are injection molded out of hard plastic such as ABS plastic. The horizontal surface 42 of the spring seat 40 supports the lower surface of the cushion 60. The riser 22 confines the inner wall 68 of the cushion 60. The lower surface 76 of the shield 70 confines the upper horizontal surface 62 of the cushion 60 and the inner surface 74 of flange 72 of the shield 70 confines the outer surface 69 of the cushion 60. The cushion 60 is contained with four hard surfaces and will absorb shock while maintaining its designed shape for many cycles.

Thus the combination of the upper spring seat 40, the O-ring 50, the cushion 60 and shield 70 provide a vertically compact shock absorbing assembly that is very effective in dissipating the substantial forces that are generated when the riser assembly 20 reaches its upper limit of extension. This allows the nozzle turret 26 to extend higher above the flange 13, placing the nozzle mounted therein considerably higher than its elevation in conventional golf and large turf rotor-type sprinklers such as the aforementioned Hunter® G990 rotor-type sprinkler. This is advantageous because lawn care professionals are allowing turf to grow longer to help conserve water in the root zone of the grass.

Figure 5A:
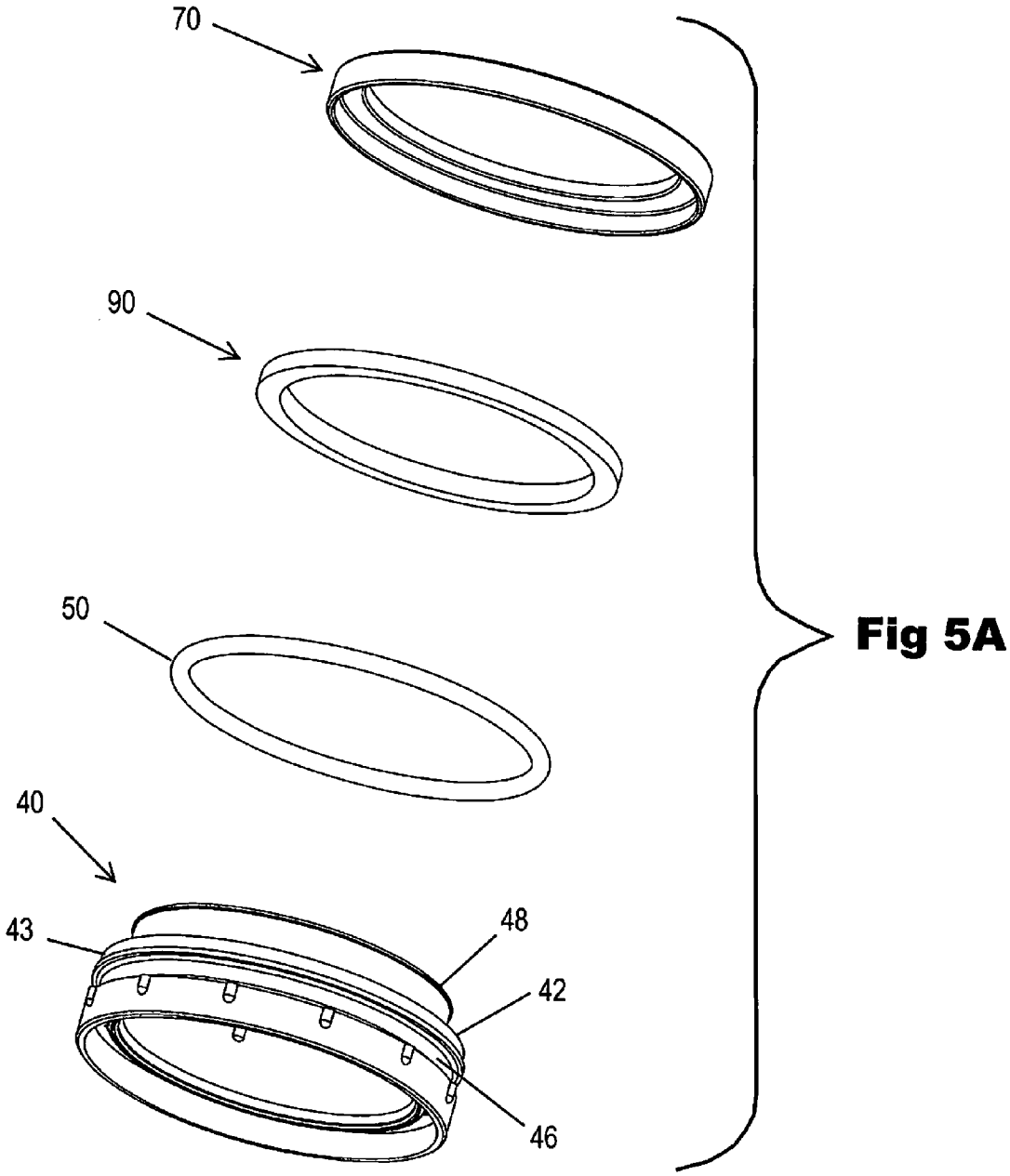
FIG. 5A is an enlarged exploded isometric view of the upper spring seat, cushion, and shield of a second embodiment of the present invention. The second embodiment is similar to the first embodiment except that the cushion is not molded with voids.
Figure 5B:
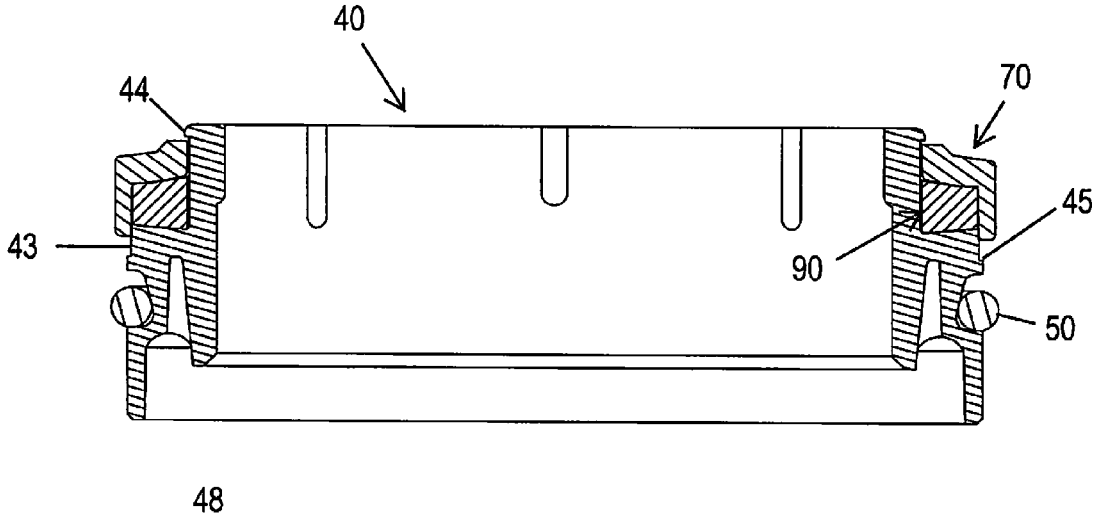
FIG. 5B is an enlarged vertical sectional view through the assembled components illustrated in FIG. 5A.
Figure 5C:
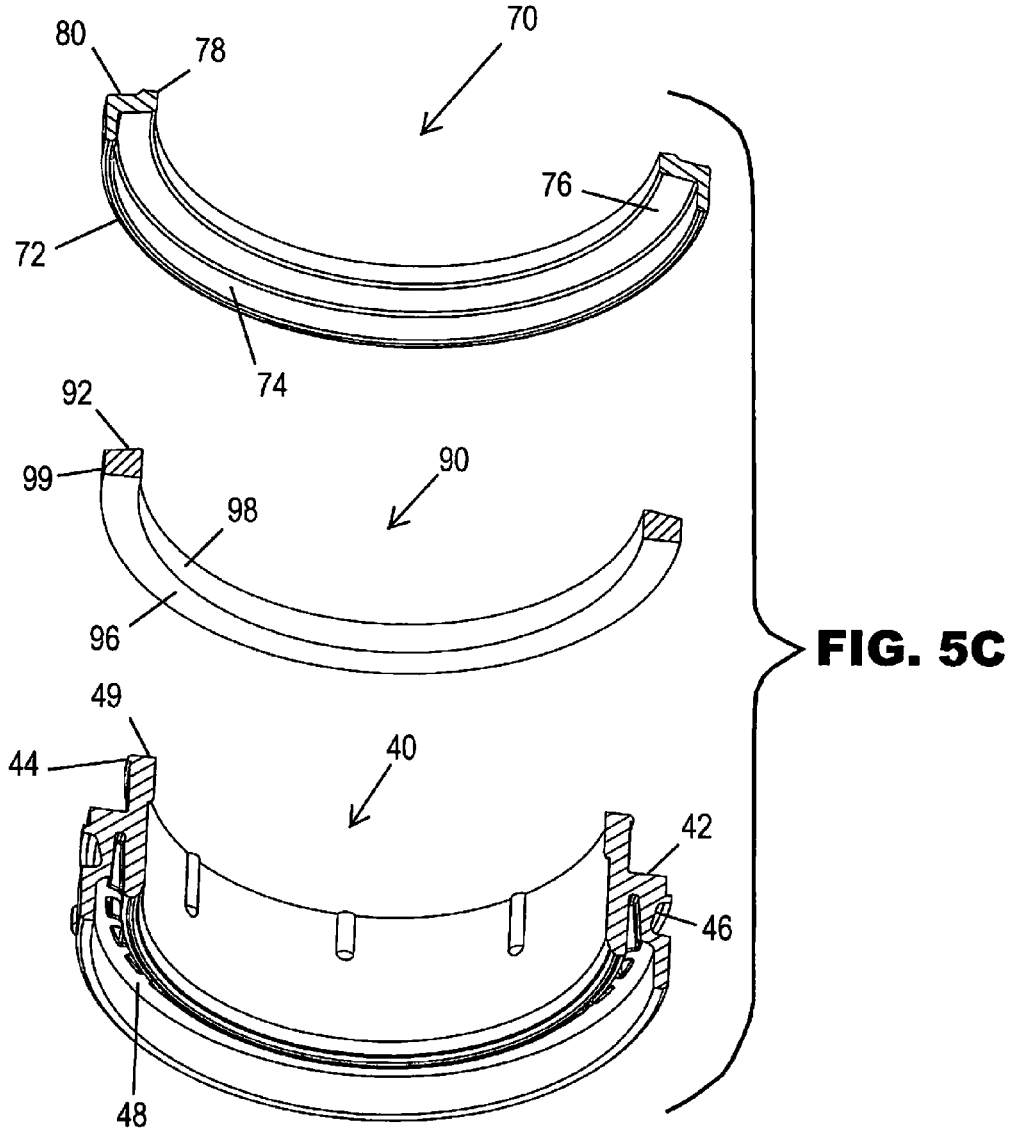
FIG. 5C is an exploded isometric view of the components illustrated in FIG. 5B in which the components have been vertically sectioned.

FIGS. 5A-5C illustrates a second embodiment of the present invention. The upper spring seat 40, O-ring 50 and shield 70 are also used in the second embodiment and have the same configuration as previously described. However, the second embodiment utilizes a ring-shaped elastomeric cushion 90 that does not have voids. The cushion 90 is supported or confined on each of its four exterior surfaces by rigid structures. The horizontal surface 42 of the upper spring seat 40 supports the lower horizontal surface 96 of the cushion 90. The riser 22 confines the inner surface 98, the lower surface 76 of the shield 70, the upper horizontal surface 92 of the cushion 90 and the inner annular surface 74 of flange 72 of the retainer 70 confines the outer surface 99 of the cushion 90. Because cushion 90 is supported on all sides by rigid structures, the cushion 90 may be formed of a softer material that is able to deform, or compress yet still retain its basic form within its confined area. The elastomeric material that is used to mold the cushion 90 may have a durometer of between about forty and fifty-five on the Shore A hardness scale. Thus the cushion 90 that is contained with four solid surfaces will absorb shock while maintaining its designed shape for many cycles.

Figure 6:
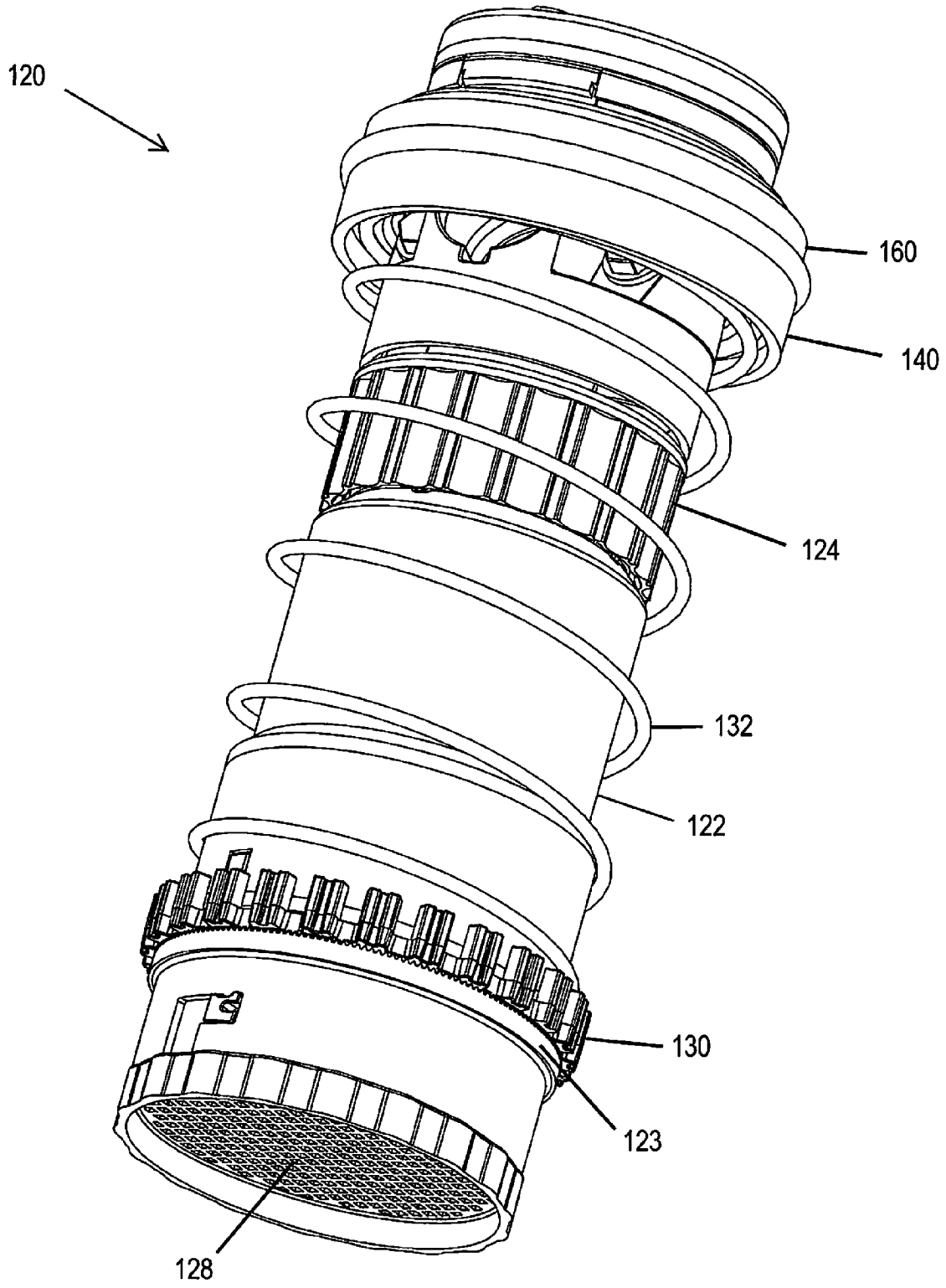
FIG. 6 is an enlarged isometric view of a riser assembly that can be used in the sprinkler of FIG. 1A and which incorporates a third embodiment of the present invention.
Figure 7:
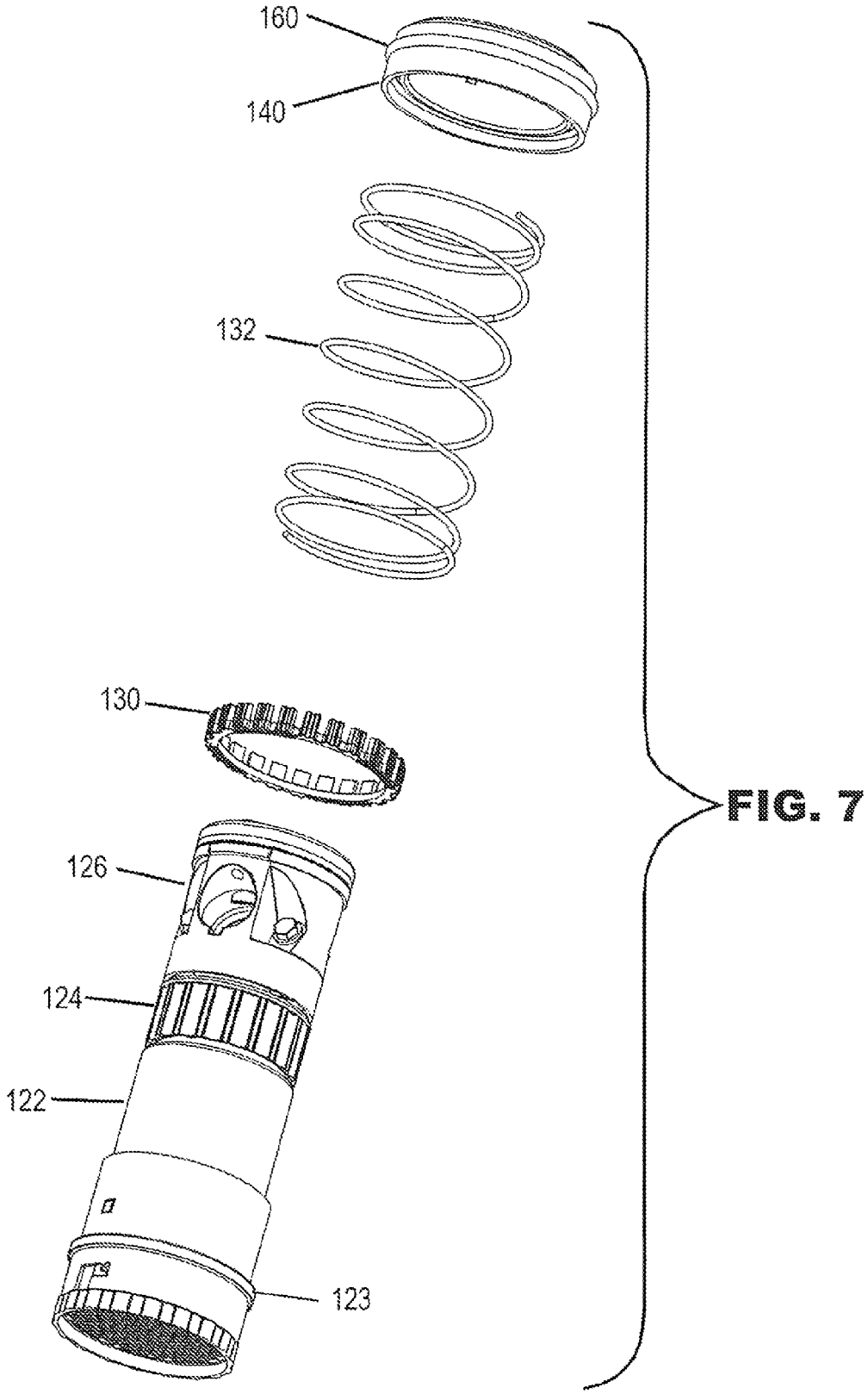
FIG. 7 is a slightly reduced exploded isometric view of the riser assembly of FIG. 6.

FIGS. 6 and 7 illustrate a third embodiment of the present invention that does not include the upper ring-shaped shield 70. A riser assembly 120 includes a riser 122 that houses the internal drive mechanisms (not illustrated). The user turns a side adjusting ring 124 to set the arc of coverage typically from about forty to three hundred and sixty degrees. A nozzle turret 126 is rotatably mounted at the upper end of the riser 122 and is driven by the gear train reduction mounted within the riser 122 according to the arc set by the setting of the side adjusting ring 124. A rock screen 128 is removably attached to the lower end of the riser 122 to keep large contaminates from entering the riser 122. A lower ring-shaped spring seat 130 loosely slides over an outer diameter of the riser 122 and sits on a radially extending flange 123 of the riser 122 to support the lower end of a coil spring 132. The upper side of the flange 123 includes small teeth that mesh with mating small teeth formed on the underside of the lower spring seat 130. This allows the user to radially adjust the position of the riser assembly 120 relative to the case 18 without removing the riser assembly 120 from the case 18. An upper ring-shaped spring seat 140 and a ring-shaped shock absorbing cushion 160 combine to reduce the shock load on the riser assembly 120 when the riser assembly 120 reaches its fully extended position.

Figure 8:
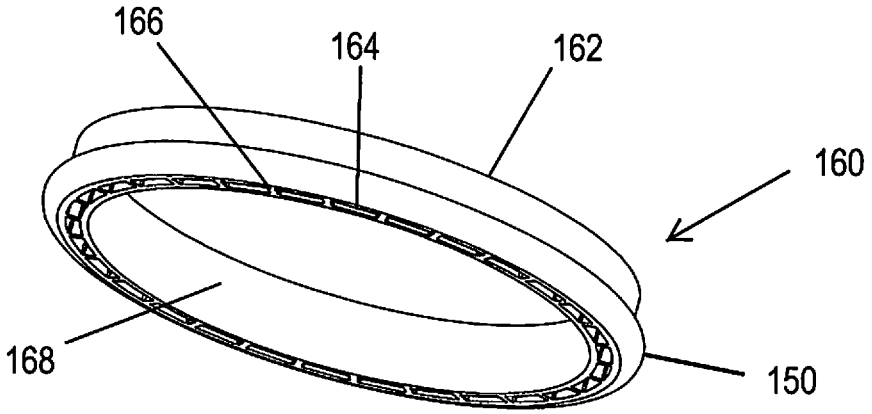
FIG. 8 is an enlarged isometric view of the cushion used in the riser assembly of FIG. 6.
Figure 9:
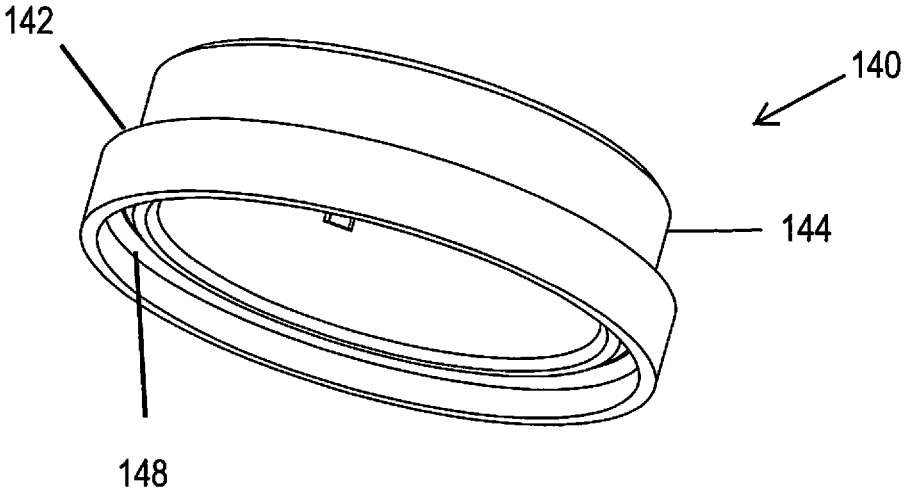
FIG. 9 is an enlarged isometric view of the upper spring seat used in the riser assembly of FIG. 6.
Figure 10:
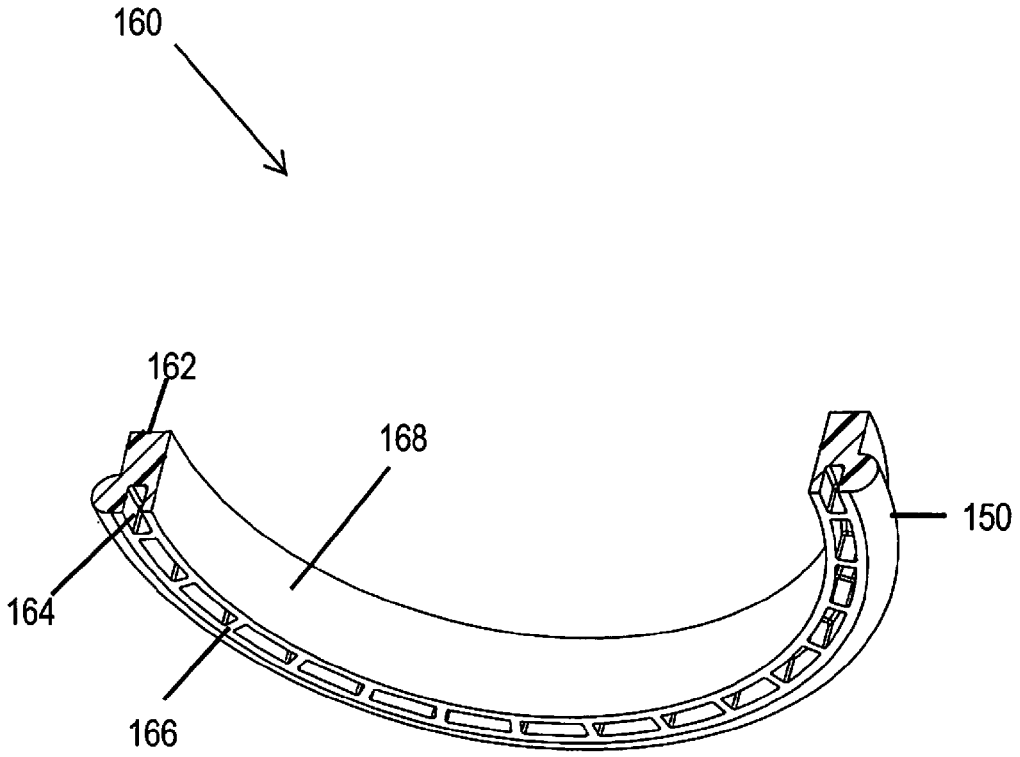
FIG. 10 is an enlarged isometric view of the cushion of FIG. 8 which has been vertically sectioned.

Referring to FIGS. 8, 9 and 10, the upper spring seat 140 includes an annular recess 148 formed on its underside and configured to receive the upper end of the coil spring 132. A rounded flange 150 formed on the outermost portion of the cushion 160 seals against an inner annular surface of the case 18 to prevent pressurized water from leaking out of the sprinkler 10. The annular flange 150 that is seated against the inner surface of the case 18 also prevents the cushion 160 from expanding outwardly under compression load. The cushion 160 sits on an annular shoulder of the upper spring seat 140. The cushion 160 is formed with a plurality of equally circumferentially spaced voids 164 that extend between an upper horizontal wall 162, a plurality of cross ribs 166, an annular inner wall 168 and an outer rounded wall 150. The voids 164 comprise identical generally rectangular pockets that open on the lower side of the cushion 160. The cushion 160 is preferably molded from a flexible elastomer, such as Pellethane TPE 2103-85AE, the same material previously identified. The cushion 160 will absorb shock by deforming and allowing the elastomeric walls and ribs to collapse slightly when the riser assembly 120 reaches its uppermost limits. The voids 164 allow the cushion 160 to be molded of a higher durometer compound than could be accomplished with a solid elastomeric cushion. For example the cushion 160 may have a durometer of between about eighty-five and one hundred on the Shore A hardness scale. Thus the cushion 160 will absorb shock while maintaining its designed shape for many cycles. The spring seat 140 has an outer axially extending flange 144 and a shoulder 142 that supports the cushion 160 when assembled. An inner axially extending wall 168 of the cushion 160 fits over the outer flange 144 to keep the cushion 160 contained radially when it is being deformed. To accomplish the shock damping effect, an upper wall 162 of the cushion 160 is retained in the sprinkler case 18 by the snap ring 16. When the riser assembly 20 reaches is full extension, the cushion 160 collapses slightly to reduce the shock on the riser assembly 20.

Figure 11:
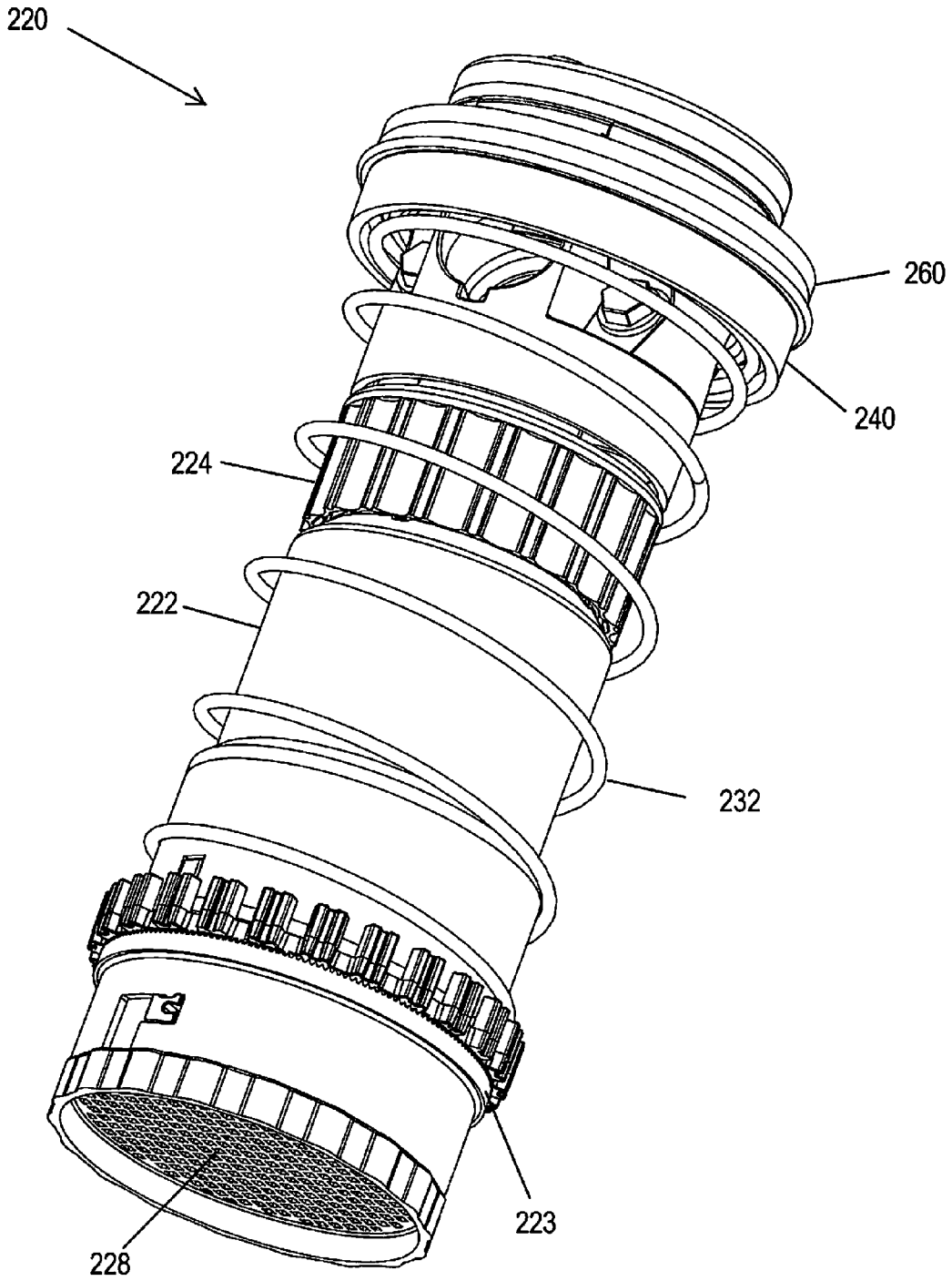
FIG. 11 is an enlarged isometric view of a riser assembly that can be used in the sprinkler of FIG. 1A and which incorporates a fourth embodiment of the present invention.
Figure 12:
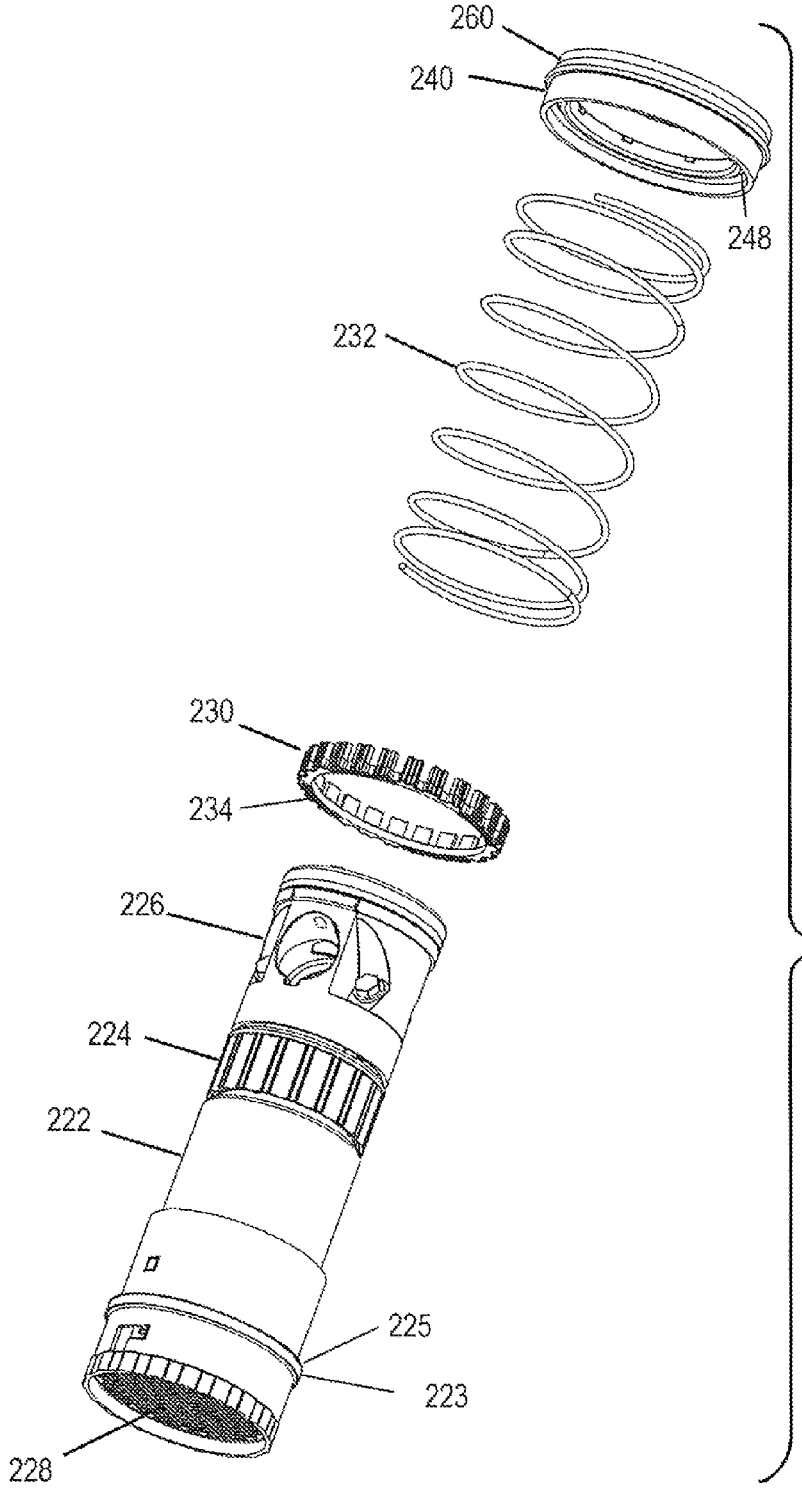
FIG. 12 is a slightly reduced exploded isometric view of the riser assembly of FIG. 11.

Referring to FIGS. 11 and 12, a fourth embodiment of the present invention includes a riser assembly 220 with a riser 222 that houses the internal drive mechanisms (not illustrated). The user turns a side adjusting ring 224 to set the arc of coverage typically from about forty to about three hundred and sixty degrees. A cylindrical nozzle turret 226 is rotatably mounted at an upper end of the riser 222 and is driven by the gear drive mechanism within the riser 222 according to the arc set by the setting of the side adjusting ring 224. A rock screen 228 is removably attached to a lower end of the riser 222 to keep large contaminates for entering the riser 222. A lower ring-shaped spring seat 230 loosely slides over an outer diameter of riser 222 and sits on a flange 223 to support a coil spring 232. The upper side of the flange 223 includes a plurality of small teeth 225 that mesh with mating small teeth 234 formed on the underside of the spring seat 230. This allows the user to radially adjust the position of riser assembly 220 relative to the case 18 without removing the riser assembly 220 from the case 18. An upper ring-shaped spring seat 240 and a ring-shaped cushion 260 combine to provide a shock absorber that reduces shock load when the riser assembly 220 reaches its fully extended position.

Figure 13:
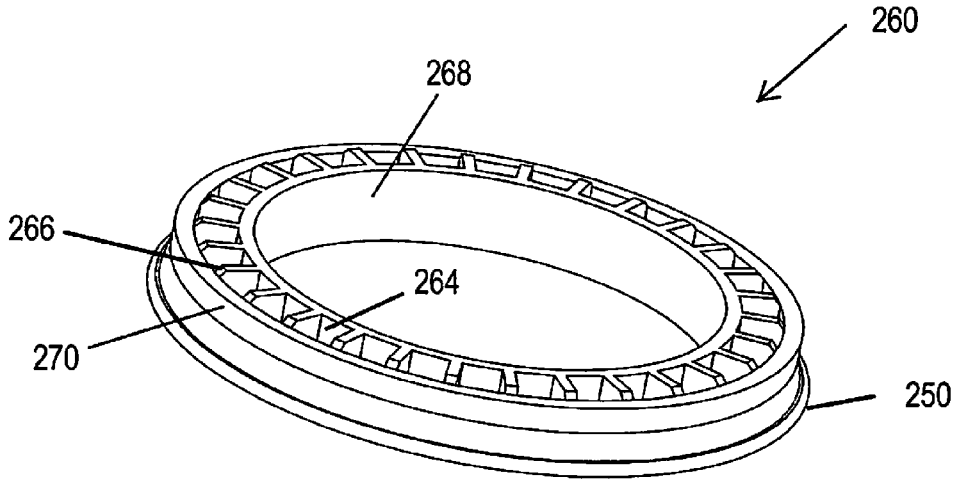
FIG. 13 is an enlarged isometric view of the cushion of the riser assembly of FIG. 11.
Figure 14:
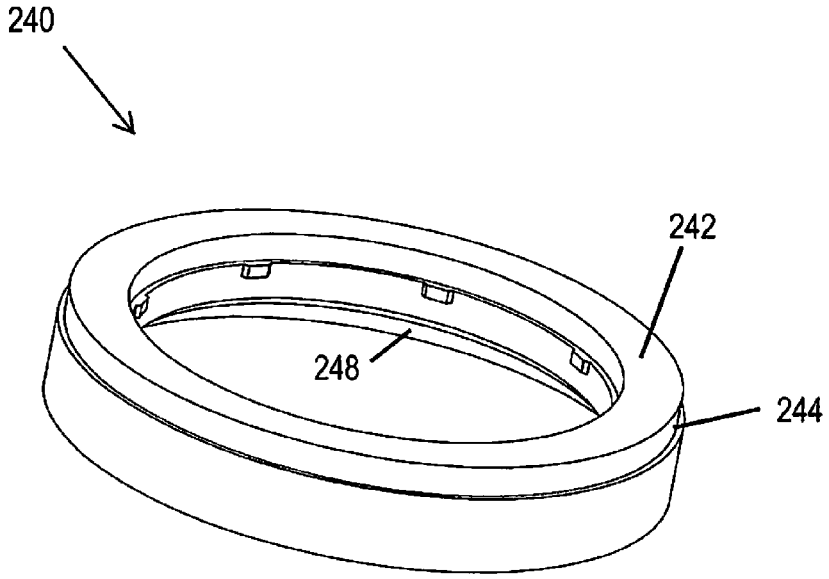
FIG. 14 is an enlarged isometric view of the upper spring seat of the riser assembly of FIG. 11.

The fourth embodiment does not use the upper ring-shaped shield 70 used in the first embodiment. Referring to FIG. 12, the upper spring seat 240 includes an annular recess 248 formed on its underside and configured to receive the upper end of the spring 232. A rounded radially projecting flange 250 (FIG. 13) formed on the outermost portion of cushion 260 seals against the inner surface of the case 18 to prevent pressurized water from leaking out of the sprinkler 10. The ring-shaped cushion 260 sits on a horizontal upper surface 242 (FIG. 14) of the upper spring seat 240. The cushion 260 includes a plurality of voids 264 that are formed between the lower wall (not illustrated), a plurality of cross ribs 266, an inner wall 268 and an outer wall 270. The voids 264 comprise equally circumferentially spaced generally rectangular pockets that open on the upper side of the cushion 260. The lower wall of the cushion 260 may be eliminated and the voids 264 may be through holes. Furthermore the lower wall may be formed with some of the voids 264 formed under the lower wall, and openings in the lower wall such that some of the voids 264 are through holes. The cushion 260 is manufactured from a flexible elastomer, such as that previously identified Pellethane TPE 2103-85AE. The cushion 260 will absorb shock by allowing the elastomeric walls and ribs to collapse slightly when the riser assembly 220 reaches its uppermost limits. The voids 264 allow the cushion to be manufactured of a higher durometer compound than could be accomplished with a solid elastomeric cushion. For example, the cushion 260 may be injection molded out of a material that has a durometer of between about eighty-five and one hundred on the Shore A hardness scale. Thus the cushion 260 will absorb shock while maintaining its designed shape for many cycles. A radial flange 250 of the cushion 260 fits over an outer axially extending wall 244 of the upper spring seat 240 to provide inner support of the seal when the riser assembly 220 is inserted into the case 18. To accomplish the shock damping effect, the upper surfaces of the ribs 266 are retained in the sprinkler case 18 by the snap ring 16. When the riser assembly 220 reaches its full extension, the cushion 260 collapses slightly to reduce the shock on the riser assembly 220.

While several embodiments have been described and illustrated, it will be apparent to those skilled in the art of designing irrigation sprinklers from the disclosure herein that the implementation of the present invention can be modified in both arrangement and detail. For example, the voids in the cushion could take many different forms such as circumferentially spaced round holes that extend axially through the cushion all the way through the upper and lower walls. The voids could be circumferentially spaced slots or notches that do not extend all the way through the cushion. Adjacent voids could have dissimilar shapes. The sprinkler may be a rotor type sprinkler, a non-rotating sprinkler, a programmable rotation sprinkler, an impact sprinkler, or any other type of irrigation sprinkler. The cushion may be installed above or below the coil retraction spring. The upper spring seat and the shield could be made of other hard materials besides plastic, including metal such as Aluminum, stainless steel or brass. Therefore the protection afforded the invention should only be limited in accordance with the following claims.

What is claimed is:

1. An irrigation sprinkler, comprising:

an outer case;

a riser assembly telescopically extensible from the outer case including a nozzle at an upper end of the riser assembly;

a coil spring surrounding the riser assembly and normally holding the riser assembly in a lower retracted position within the outer case, the coil spring being dimensioned and configured to permit extension of the riser assembly to a raised upper position when pressurized water is introduced into the outer case; and a shock absorber, the shock absorber including:

a cushion made of an elastomeric material retained by a ring-shaped member made of a hard material, the ring-shaped member being positioned between the riser assembly and the outer case;

a spring seat that surrounds the riser assembly and holds a downstream end of the coil spring, the spring seat positioned between the cushion and the coil spring; and a ring-shaped shield that surrounds the riser assembly and at least a portion of the spring seat, the shield configured to move with respect to the spring seat in a direction parallel to the telescopic extension of the riser assembly, the shield comprising:

an annular flange surrounding a radially-outward surface of the cushion; and an upper annular wall connected to the annular flange, the upper annular wall positioned on a side of the cushion opposite the spring seat; wherein the cushion is surrounded by two or more of the spring seat, the ring-shaped shield, and the riser assembly.

2. The sprinkler of claim 1 and further comprising a lower spring seat that surrounds the riser assembly and holds a lower end of the coil spring.

3. The sprinkler of claim 1 wherein cushion has voids that are configured as outwardly opening pockets.

4. The sprinkler of claim 3 wherein the pockets are generally box-shaped.

5. The sprinkler of claim 1 wherein the cushion is ring-shaped.

6. The sprinkler of claim 1 wherein the ring-shaped member is configured as an upper spring seat that supports a first side of the cushion and a shield made of the hard material supports a second side of the cushion.

7. The sprinkler of claim 1 wherein the ring-shaped member supports four outer surfaces of the cushion.

8. The sprinkler of claim 1 wherein the shock absorber includes an O-ring that is positioned between the ring-shaped member and an inner wall of the case.

9. An irrigation sprinkler, comprising:

an outer case;

a riser assembly telescopically extensible from the outer case including a nozzle turret rotatably mounted at an upper end of a riser;

a coil spring surrounding the riser assembly and normally holding the riser assembly in a lower retracted position within the outer case, the coil spring being dimensioned and configured to permit extension of the riser assembly to a raised upper position when pressurized water is introduced into the outer case;

a cushion made of an elastomeric material retained inside the outer case and surrounding the riser assembly, the cushion including a plurality of circumferentially spaced outwardly opening pockets that facilitate deformation that absorbs the shock of the impact caused by rapid extension of the riser assembly to its raised upper position, a spring seat that surrounds the riser assembly and holds a downstream end of the coil spring, the spring seat positioned between the cushion and the coil spring; and a shield positioned adjacent the cushion, the shield configured to move with respect to the spring seat in a direction parallel to the telescopic extension of the riser assembly; wherein the cushion is surrounded by two or more of the spring seat, the shield, and the riser assembly.

10. The sprinkler of claim 9 and further comprising a second spring seat that surrounds the riser assembly, holds a second end of the coil spring and engages a side of the cushion.

11. The sprinkler of claim 10 wherein the second spring seat is formed with an axially extending wall that engages an inner wall of the cushion.

12. The sprinkler of claim 9 and further comprising the shield that surrounds the riser assembly and engages an upper side of the cushion.

13. The sprinkler of claim 9 wherein the pockets open downwardly.

14. The sprinkler of claim 9 wherein the pockets are generally box-shaped.

15. The sprinkler of claim 9 wherein the pockets are equally circumferentially spaced.

16. The sprinkler of claim 9 wherein the pockets are formed between radially extending ribs.

17. The sprinkler of claim 9 wherein the pockets open upwardly.

18. In a rotor-type sprinkler having a riser assembly normally held in a retracted position inside an outer case by a coil spring, the improvement comprising a shock absorber that surrounds the riser assembly and includes a ring-shaped cushion positioned between an upper ring-shaped spring seat that sits on an upper end of the coil spring and a ring that is connected to an upper end of the case, the cushion being molded of an elastomeric material and formed with a plurality of circumferentially spaced hollow voids that all the cushion to deform when the riser assembly rapidly reaches an uppermost extended position whereby damage to components of the sprinkler otherwise due to the shock of impact of the riser assembly will be minimized.

19. The sprinkler of claim 18, wherein each hollow void comprises a perimeter defining an opening to the hollow void.

20. The sprinkler of claim 19, wherein the perimeter of each hollow void is defined at least partially by one or more radially-extending ribs.

* * * * *